United States Patent [19]

Spencer

[11] Patent Number: 4,979,911

[45] Date of Patent: Dec. 25, 1990

[54] CABLE COLLET TERMINATION

[75] Inventor: Mark Spencer, Maricopa, Ariz.

[73] Assignee: W. L. Gore & Associates, Inc., Newark, Del.

[21] Appl. No.: 385,833

[22] Filed: Jul. 26, 1989

[51] Int. Cl.[5] ..... H01R 17/18

[52] U.S. Cl. ..... 439/583; 439/434

[58] Field of Search ..... 439/843, 851, 852, 578–585, 439/675, 668, 669, 433, 434

[56] References Cited

U.S. PATENT DOCUMENTS

| | | | |
|---|---|---|---|
| 1,348,434 | 3/1920 | Marshick | 439/851 |
| 1,451,548 | 4/1923 | Kreicheld | 439/851 |
| 3,042,288 | 6/1962 | Edlen et al. . | |
| 3,184,706 | 5/1965 | Atkins . | |
| 4,239,318 | 12/1980 | Schwartz | 439/609 |
| 4,331,374 | 5/1982 | Phillips | 439/584 |
| 4,688,877 | 8/1987 | Dreyer | 439/584 |

FOREIGN PATENT DOCUMENTS 1494323 11/1974 United Kingdom .

*Primary Examiner*—David L. Pirlot

*Attorney, Agent, or Firm*—Gary A. Samuels

[57] ABSTRACT

A cable collet connector for use in terminating the shield conductor of coaxial cables that is quickly and easily fitted to a coaxial cable and provides a secure mechanical and electrical connection.

7 Claims, 1 Drawing Sheet

5

Fig. 1
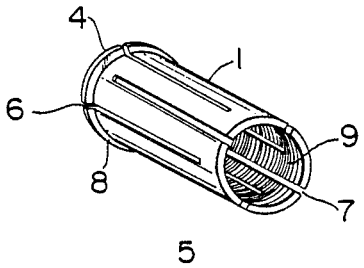
Fig. 2
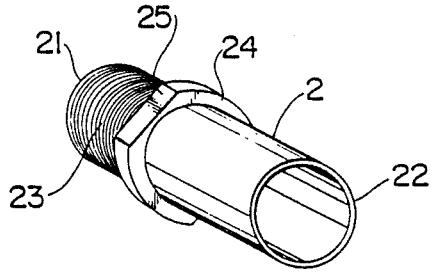
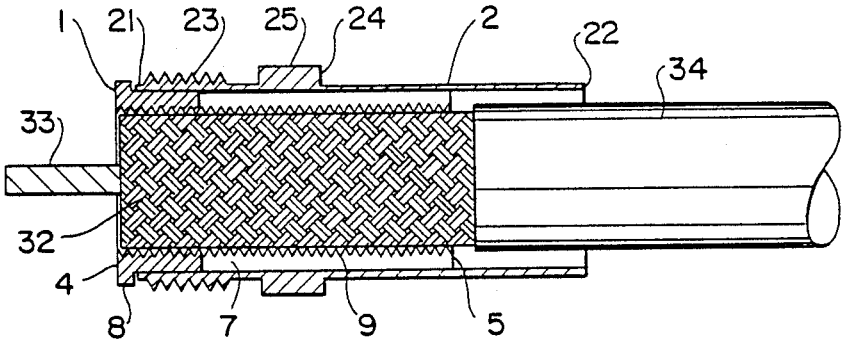
Fig. 3

CABLE COLLET TERMINATION

FIELD OF THE INVENTION

This invention relates to electrical connectors for use in terminating coaxial cables, specifically to a connector having a collet that is quickly and easily fitted to the shield of a coaxial cable.

The connector provides a secure electrical and mechanical connection to the shield of the cable.

BACKGROUND OF THE INVENTION

The fitting of termination connectors to coaxial cables has heretofore been a laborious and time consuming operation. These coaxial connectors have previously been of generally three attachment types: they have been soldered to the shield of the coaxial cable, they have been connected to the shield of the coaxial cable by compressing the tubular form of the connector to the shield with the aid of a compression or crimping tool, or they have been both soldered and crimped. The connector fitted to the shield of the coaxial cable by soldering functions well, being mechanically secure and providing a good electrical connection to the cable shield. However, the process of soldering this type of connector to the cable shield is typically time-consuming and laborious. When the connector is applied to the shield by crimping or compression, the connection may be made fairly quickly, however, there is a great risk of crushing the dielectric insulation of the cable and thus compromising or perhaps ruining the impedance characteristics of the coaxial cable. This method also creates impedance discontinuities which adversely affect electrical performance at high frequency. The third method works well, but is complicated and time consuming.

Previously available coaxial shield connectors have been complex, requiring multiple components. Several require the use of a ferrule inserted between the cable shield and the cable dielectric insulation. These complex and difficult to fit components only increase termination time and expense.

SUMMARY OF THE INVENTION

The disclosed electrical connector terminating the shield conductor of a coaxial cable comprises the combination of:

(a) a tubular collet of electrically conductive material, having a first and second end, an inner and outer surface, and a wall, having at least four slots longitudinally disposed and of length less than the length of the collet and more than half the length of the collet, the slots extending through the wall of the collet beginning alternately from the first and second ends of the collet, having serrations on some portion of the inner surface of the collet, wherein the outer surface of the collet is tapered, having a larger outside diameter at the first end than at the second end;

(b) a tubular hat of electrically conductive material having a first and second end and an inner and outer surface, wherein the inner surface of the hat is tapered, having a larger inside diameter at the first end than at the second end, the angle of taper being the same as for the collet, the diametrical dimensions of the taper being appropriate to cause compression of the collet when the hat is slideably fitted over the collet.

BRIEF DESCRIPTION OF THE DRAWINGS

FIG. 1 represents a three dimensional perspective view of the collet.

FIG. 2 represents a three dimensional perspective view of the hat with a male threaded segment.

FIG. 3 represents a cross-sectional view of the collet and hat combination as fitted to a coaxial cable.

DESCRIPTION OF THE INVENTION WITH REFERENCE TO THE DRAWINGS

The cable collet termination comprises the combination of two components, an inner tubular component in the form of a collet and an outer tubular component hereafter referred to as a "hat". The collet, as shown in FIG. 1, is made of an electrically conductive material, preferably of metal, of tubular construction and has a first (4) and second end (5). Slots (6) and (7) are cut through the wall of the tube, are longitudinally disposed and extend inwardly at least half and preferably more than half the length of the tube. There are at least four such slots; more than four slots may be provided. The slots are made so as to extend inwardly from alternate ends of the collet. In a preferred alternative, slot (7) may be wider than slot (6). Another preferred alternative incorporates a flange (8) at the first end (4) of the collet. In still another alternative, the flange (8) at the first end (4) of the collet is made so as to both increase the outside diameter and decrease the inside diameter of the collet for the width of the flange. The bore of the collet is provided with many fine grooves or serrations (9) which may be oriented to run circumferentially or more preferably in a helical pattern, as in a screw thread. In another alternative, the serrations may run longitudinally. The serrations regardless of orientation will preferably extend for the entire length of the bore of the collet. The outer surface of the collet will preferably be tapered from end to end so that the outside diameter of the collet is larger at the first end than at the second end. This taper is preferably of one-half degree to ten degrees and is most preferably of one degree.

With reference to FIG. 2, the compression hat portion of the cable collet termination is a tubular component having a first (21) and second end (22), made from electrically conductive material, preferably metal. Most of the length of the bore of the hat (2) is preferably tapered from one end to the other, the taper being of the same angle as the taper on the collet (1) portion of the assembly. The largest diameter of the taper is located at the first end (21) of the hat (2), the smallest diameter of the taper being located within the bore of the hat and most or all of the distance to the hat's second end (22). Both the largest and smallest diameters of the taper are of such dimensions as to securely bind the collet to the cable when a cable termination is completed. Any remaining untapered length of the bore of the hat (2) may be of constant diameter and of a slightly larger diameter than the outside diameter of the insulating jacket (34), in order that a short length of the jacketed cable can be accommodated within the hat (2). This straight bored portion of the hat (2) may be of the same or smaller diameter as the smallest diameter of the taper.

In one preferred alternative, the exterior of the hat (2) is threaded (23) at the first end, the threads (23) preferably extending for about one-third to about one-half of the length of the hat (2). This male threaded segment (23) will mate to a female threaded segment of the opposite connector necessary to make a completed connection of the cable to a device or another cable. The use of threads represents a convenient means for connecting to an opposite connector. Any other means providing good mechanical and electrical connection may be used as well.

The male threaded segment (23) of the hat is followed by a short segment (24), increasing the outside diameter of the hat (2) for a short distance. The flange (24) is typically located at about the center of the length of the hat. Its function is to provide wrench flats (25) for the tightening of the hat (2) to the female threaded segment of the opposite connector. This configuration allows many industry standard connector interface types to be adapted. The remainder of the hat externally is of constant diameter which, combined with the optional straight non-tapered bore of the second end of the hat, provides a relatively thin walled sleeve intended to cover a short segment of the cable jacket (34). This is only one of several possible configurations. The specific design of the outside of the hat is not important since its purpose is only to provide a means by which an industry standard interface or a new interface design may be mechanically attached to the collet termination which is the subject of this patent.

As shown in FIG. 3, these components are utilized in terminating a coaxial cable by first stripping any insulating outer jacket (34) from the cable so as to expose the conductive shield (32). The shield (32) may be solder tinned or not depending on the type of shield utilized and the quality of fit to the collet that will be appropriate for the service required. A portion of the exposed shield and underlying insulation are cut and stripped away so as to expose the center conductor or conductors (33). These conductors may be terminated at this point or terminated subsequent to the fitting of the shield termination.

The cable collet termination is assembled by first sliding the hat (2) component onto the cable second end (22) first and far enough that it is beyond the exposed shield (32) and over the jacketed portion (34) of the cable. The collet (1) is next fitted over the exposed shield (32), second end (5) first, so that the flange (8) is flush with the end of the shield (32) and dielectric cable insulation. The hat (2) is then pulled back over the collet (1) while maintaining the collet (1) in its fitted position, mating the internal taper of the hat (2) with the external taper of the collet (1). The taper and inside dimension of the hat is such that it causes compression of the collet, the longitudinal slots in the collet allowing this to occur. Because the collet is alternately slit from opposite ends, the compression takes place relatively uniformly over the surface of the shield, thus minimizing any tendency to crush the insulation of the cable. As the collet is compressed, the serrations (9) provided on the inner surface of the collet bite into the surface of the exposed shield (32) and thus furnish the grip required for a good electrical and mechanical connection. In one configuration where the serrations (9) are in the form of threads, prior to the complete compression of the collet (1), the collet (1) and hat (2) may be rotated on or off the end of the cable, thereby allowing adjustment in the electrical phase length of the cable assembly. The collet can be placed in any position that maintains secure mechanical connection in order to adjust the electrical phase length of the assembly.

EXAMPLE

A cable collet termination was manufactured for the purpose of terminating a microwave coaxial cable. Both the collet and hat were manufactured from stainless steel. The collet was made to be 0.420 inch long, of 0.173 inch constant inside diameter and 0.235 inch outside diameter at the largest end of the external taper, the taper being of one degree. Serrations were cut into the bore of the collet by running a 0.201–48 tap through the full length of the bore. Eight slots of 0.380 inch length were cut through the wall of the collet. They were uniformly spaced 45 degrees apart and were cut beginning from alternate ends of the collet. The four slots beginning from the first end were cut 0.007 inch wide; the four slots beginning from the second end were cut 0.020 inch wide. The collet was made to incorporate an outside flange at its first end, the flange being of 0.250 inch outside diameter and 0.020 inch width. The compression hat was made to a length of 0.600 inch with a set of 5/16-32 UNEF-2E external threads extending from the first end for a distance of about 0.110 inch. A flange of 0.085 inch width and 0.355 inch outside diameter was incorporated into the exterior of the hat, and having 0.312 inch wrench flats, the flange located 0.165 inch from the threaded first end of the hat. The remaining length of the hat was made to an outside diameter of 0.250 inch. The bore of the hat was tapered one degree from a largest diameter of 0.233 inch at the threaded end. The bore of the opposite end was of constant diameter of 0.218 inch for a distance of 0.200 inch, at which point it met the tapered portion of the bore without a step. The assembly was fitted to a coaxial cable of the type available from W. L. Gore and Associates, Inc., Phoenix, Ariz. in G2S01S01028.0 cable assemblies. The termination was made by first stripping the plastic jacket from the cable for a distance of 1.0 inch. The exposed shield, consisting of wire braid, was dipped into a hot solder pot for tinning. About 0.575 inch of shield and dielectric insulation were stripped away, exposing the same length of center conductor. This exposed center conductor was tinned in a solder pot for later termination. The hat was slid onto the cable second end first and beyond the tinned shield. The collet was fitted over the tinned shield second end first so that the flanged end was flush with the edge of the shield and dielectric insulation. The collet was maintained in this position while the hat was pushed back over the collet. The hat was temporarily made up to a female threaded opposing connector and tightened to 20 inch-pounds to ensure an adequate connection between the cable shield and the collet. The female connector was removed. The center conductor was trimmed and a contact was soldered to the center conductor. An adapted SMA interface was then mated to the threaded portion of the hat.

Four such terminated coaxial cable assemblies were made up utilizing collet cable terminations fabricated as described above on both ends of each cable. The characteristic impedance of a 24 inch length of coaxial cable so terminated was measured at 50 ohms. The mechanical integrity of each of the four samples was tested by applying a tensile load to both ends of the termination of each cable. The load was applied sequentially to each sample in loads of 25, 30, 35, 40, 45 and 50 pounds. The SMA interfaces and the collet/cable area was inspected for degradation after each pull test; none was found. Each sample was also tested for voltage to standing wave ratio (VSWR) after each pull test. All four samples measured less than 1.35:1 at 18.0 gHz through pulls of 45 pounds. At 50 pounds two samples exceeded VSWR of 1.35:1 at 18.0 gHz due to cable tensile strength failure. The remaining two samples were still below a VSWR of 1.35:1 at 18.0 gHz after having been pulled to 50 pounds tension.

I claim:

1. An electrical connector for terminating the shield conductor of a coaxial cable comprising the combination of:

(a) a tubular collet of electrically conductive material, having a first and second end, an inner and outer surface, and a wall, having at least four slots longitudinally disposed and of length less than the length of the collet and more than half the length of the collet, the slots extending through the wall of the collet beginning alternately from the first and second ends of the collet, having serrations on some portion of the inner surface of the collet, wherein the outer surface of the collet is tapered, having a larger outside diameter at the first end than at the second end;

(b) a tubular hat of electrically conductive material having a first and second end and an inner and outer surface, wherein the inner surface of the hat is tapered, having a larger inside diameter at the first end than at the second end, the angle of taper being the same as for the collet, the diametrical dimensions of the taper being appropriate to cause compression of the collet when the hat is slideably fitted over the collet.

2. An electrical connector of claim 1 wherein the serrations on the inner surface of the collet are int he form of a screw thread.

3. An electrical connector of claim 1 wherein the first end of the collet has a flange.

4. An electrical connector of claim 1 wherein the slots through the wall of the collet beginning from the first end of the collet are of different width than the slots beginning from the second end of the collet.

5. An electrical connector of claim 1 wherein the outer surface of the hat has near the longitudinal midpoint a flange of increased diameter, the outer surface of said flange having two diametrically opposed flat surfaces for use with a wrench, said hat having threads on the outer surface between the first end and the flange.

6. An electrical connector of claim 5 wherein the serrations on the inner surface of the collet are in the form of a screw thread.

7. An electrical connector of claim 5 wherein the serrations on the inner surface of the collet are oriented to run longitudinally.

* * * * *